US010729950B2

(12) United States Patent
Gonzalez et al.

(10) Patent No.: US 10,729,950 B2
(45) Date of Patent: Aug. 4, 2020

(54) IRON GOLF CLUB WITH BADGE

(71) Applicant: Acushnet Company, Fairhaven, MA (US)

(72) Inventors: Oswaldo Gonzalez, San Jacinto, CA (US); Marni D. Ines, San Marcos, CA (US); Gery M. Zimmerman, Fallbrook, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/255,619

(22) Filed: Jan. 23, 2019

(65) Prior Publication Data

US 2019/0151722 A1 May 23, 2019

Related U.S. Application Data

(63) Continuation of application No. 15/589,247, filed on May 8, 2017, now Pat. No. 10,220,272, which is a continuation-in-part of application No. 15/252,674, filed on Aug. 31, 2016, now abandoned.

(51) Int. Cl.
*A63B 53/04* (2015.01)

(52) U.S. Cl.
CPC .. *A63B 53/0475* (2013.01); *A63B 2053/0416* (2013.01)

(58) Field of Classification Search
CPC ..... A63B 53/047; A63B 2053/0416
See application file for complete search history.

(56) References Cited

U.S. PATENT DOCUMENTS

| | | | | |
|---|---|---|---|---|
| 2,077,377 | A | 4/1937 | Link | |
| 4,826,172 | A | 5/1989 | Antonious | |
| 5,766,092 | A | 6/1998 | Mimeur et al. | |
| 7,008,331 | B2 | 3/2006 | Chen | |
| 7,371,190 | B2 | 5/2008 | Gilbert | |
| 8,088,025 | B2 * | 1/2012 | Wahl | A63B 53/047 473/346 |
| 8,157,673 | B2 | 4/2012 | Gilbert | |
| 8,328,663 | B2 | 12/2012 | Wahl | |
| 8,517,863 | B2 | 8/2013 | Wahl | |
| 8,753,219 | B2 | 6/2014 | Gilbert | |
| 8,920,261 | B2 | 12/2014 | Taylor et al. | |
| 8,961,336 | B1 | 2/2015 | Parsons et al. | |
| 9,265,995 | B2 | 2/2016 | Wahl | |
| 9,597,562 | B2 | 3/2017 | Dipert | |
| 2011/0086723 | A1 * | 4/2011 | Gilbert | A63B 53/047 473/291 |
| 2016/0346635 | A1 * | 12/2016 | Sander | A63B 53/047 |
| 2016/0346641 | A1 * | 12/2016 | Akiyama | A63B 53/0466 |
| 2017/0333765 | A1 * | 11/2017 | Parsons | A63B 53/047 |

* cited by examiner

*Primary Examiner* — Michael D Dennis
(74) *Attorney, Agent, or Firm* — Richard J. Albright

(57) ABSTRACT

A golf club head with a multi-level badge is disclosed herein. More specifically, the golf club head in accordance with the present invention is an iron type golf club head with a multi-level badge that on one level contacts a rear surface of the striking face of the golf club head, and a second level of the multi-level badge contacts a rear surface of a cavity created by the chassis of the golf club head. The gap created between the striking face of the golf club head and the rear of the chassis could be filled with a fluid that has a temperature variable viscosity, providing vibration attenuation.

11 Claims, 9 Drawing Sheets

IRON GOLF CLUB WITH BADGE

CROSS REFERENCE TO RELATED APPLICATIONS

This application is a continuation (CON) of U.S. patent application Ser. No. 15/589,247, filed on May 8, 2017, which is a continuation-in-part (CIP) of U.S. patent application Ser. No. 15/252,674, filed Aug. 31, 2016, the disclosure of which are both incorporated by reference in their entirety.

FIELD OF THE INVENTION

The present invention relates generally to an iron golf club with a badge. More specifically, the present invention discloses an iron type golf club head with a badge located near a rear portion of the iron type golf club head providing support to the golf club head. The rear badge of this iron type golf club head may generally have multi-level badges creating multiple different depths, allowing the insert to contact not only the rear outer surface of the golf club head, but also contact the rear of the striking. This multi-level badge not only provides an improvement in the overall aesthetics of the golf club head, it also improves the damping properties of the iron type golf club head.

BACKGROUND OF THE INVENTION

The game of golf often involves the usage of a vast variety of different equipment. Generally speaking, a golfer may have several different types of clubs differing in three major categories; woods, irons, and a putter. Although different golfers may differ on what their favorite type of golf club in the bag may be, most all of them will say that their iron type golf clubs play a crucial part in their golf game.

Within the iron type category, the types of golf clubs are generally separated into two major categories, a muscle back type iron and a cavity back type iron. A muscle back type iron may generally be defined as a golf club formed from a unitary piece of metal that has a portion of increased thickness called a "muscle portion". Muscle back type irons have been existence since the early days of golf, and U.S. Pat. No. 2,007,377 to Link is an illustration of an early design of a muscle back iron. A cavity back iron, on the other hand, may generally refer to a golf club that creates an opening near the back portion of the golf club head. Although cavity type irons may generally have an open cavity that is exposed like shown in U.S. Pat. No. 4,826,172 to Antonious, the cavity back iron may also include a closed opening construction that creates an enclosed volume as shown in U.S. Pat. No. 5,766,092 to Mimeur et al.

Although muscle back irons still remain the gold standard as the go to equipment for the better golfer, the invention of cavity back irons provides significant performance advantages compared to the traditional muscle back irons. First and foremost, by removing weight from the back portion of the golf club, cavity back irons may generally be able to increase the moment of inertia of the golf club head by placing weight near the perimeter extremities of the golf club head. In addition to increasing the moment of inertia, cavity back irons can further improve the performance of the iron type golf club head by increasing the distance of the iron type golf club head. In general, golf clubs can achieve more distance by increasing the coefficient of restitution of the striking face, which cavity back irons can achieve by thinning out the striking face.

Due to the fact that cavity back irons require an opening in the rear portion of the golf club head that can be cosmetically unappealing, golf club designers have attempted to remedy that deficiency by adding a badge to fill the cavity of the opening. U.S. Pat. No. 8,920,261 to Taylor et al. provides one illustration of an attempt at a badge that helps achieve that goal.

Focusing our discussion further on the cavity back irons, as discussed above that in order to improve the performance of these types of irons, golf club designers often try to create an extremely thin face to allow for more deflection of the face during impact with a golf ball. The increased deflection of the face during impact with a golf ball will generally allow the golf ball to travel further than a thicker face counterpart, thereby increasing the performance of the cavity back iron type golf club. U.S. Pat. No. 7,008,331 to Chen illustrates one of the earlier examples of experimenting with a thin face iron to increase the performance of an iron type golf club head.

Recognizing that thinner materials are generally less durable than thicker materials, golf club designers have attempted to counteract the durability issues associated with the thinning of the striking face portion. U.S. Pat. No. 8,961,336 to Parsons et al. provides one example of a way to address this issue by filling the internal cavity of an enclosed volume iron golf club head with a polymer to provide some structural support for the thinned face.

Despite all the attempts to improve upon the performance of an iron type golf club head, none of the designs in the current industry is capable of providing an aesthetically appealing way to address the increasing need of strength and toughness for the striking face as it gets thinner and thinner to improve the performance in a cavity type iron; especially in a cavity type iron that may or may not have a hollow cavity allowing for a filler.

BRIEF SUMMARY OF THE INVENTION

One aspect of the present invention is a golf club head comprising of a striking face portion located at a frontal portion of the golf club head; a chassis, connected to an aft portion of the striking face portion, creating a rear cavity having an opening, wherein the opening provides access to a rear surface of the striking face portion, and a multi-level badge further comprising a first level and a second level, attached to said the cavity. The rear cavity of the chassis further comprises at least one support tab around a perimeter of the rear cavity, and wherein the first level of the multi-level badge substantially contacts the rear surface of the striking face portion, and the second level substantially contacts a rear surface of the support tab.

In another aspect of the present invention, an iron type golf club head comprising of a striking face portion located at a frontal portion of the iron golf club head; a chassis, connected to an aft portion of the striking face portion, creating a rear cavity having an opening, wherein the opening provides access to a rear surface of the striking face portion, and a multi-level badge further comprising a first level and a second level, attached to the rear cavity, wherein the first level of the multi-level badge substantially contacts the rear surface of the striking face portion, and the second level substantially contacts a rear surface of the cavity, and wherein the multi-level badge only experiences compressive force upon impact with a golf ball.

In another aspect of the present invention the rear surface of the striking face and a lower frontal portion of a muscle portion of the chassis creates a gap and a void, and a fluid, with a temperature variable viscosity, at least partially fills the gap, contacting the rear surface of the striking face portion and the lower frontal portion of the muscle portion of the chassis.

In another aspect of the present invention, the fluid with a temperature variable viscosity at least partially fills the gap as well as the void, connecting the gap and the void.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
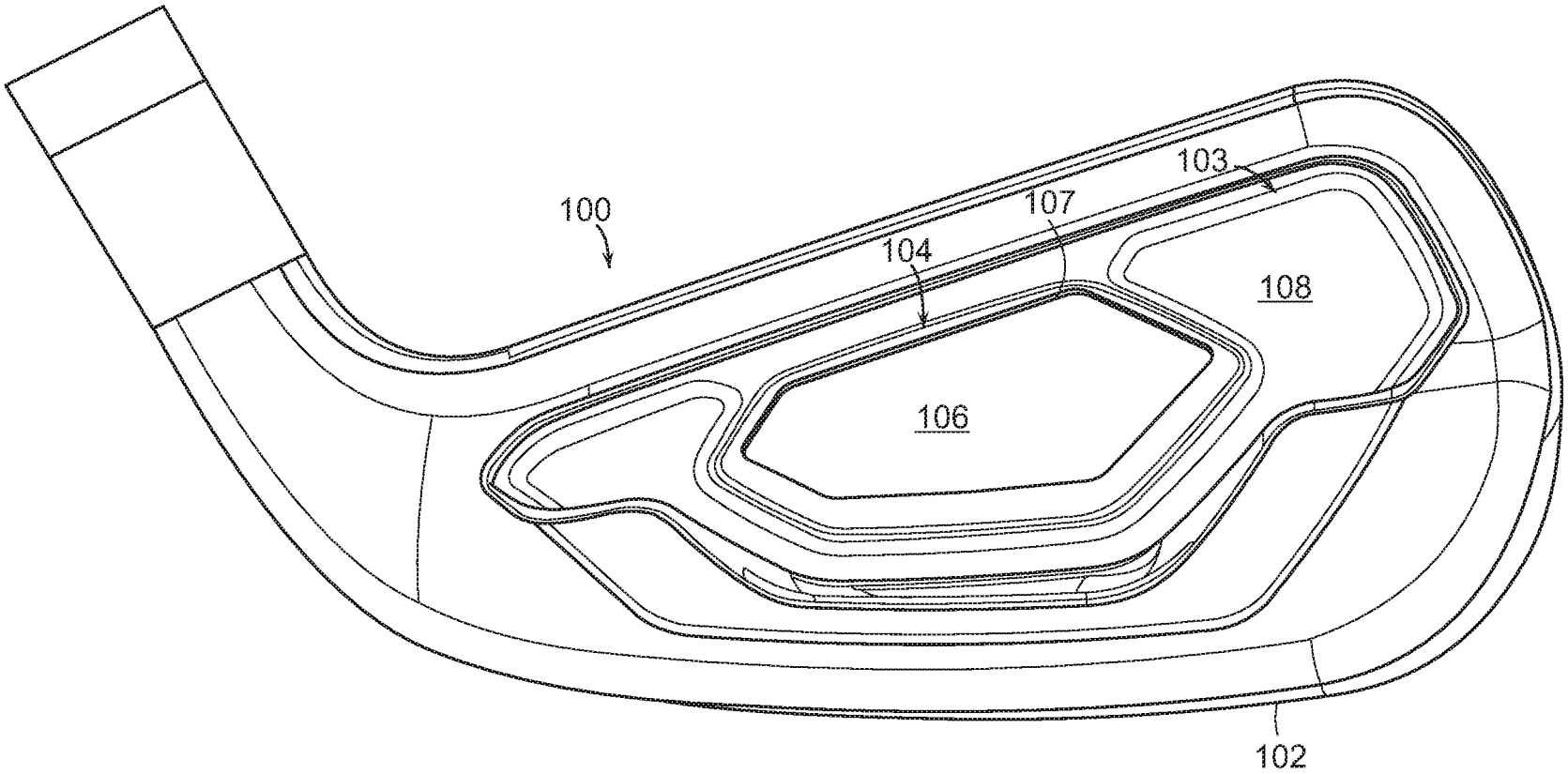
FIG. 1 shows a perspective back view of a golf club head in accordance with an exemplary embodiment of the present invention.

FIG. 1 of the accompanying drawings shows a perspective view of a golf club head 100 in accordance with an exemplary embodiment of the present invention. As seen in FIG. 1, the type of iron type golf club head 100 shown here is a cavity back type iron, having a cavity 103 at the rear portion of the chassis 102 of the golf club head 100. The cavity 103, shown in this embodiment of the present invention, may generally be covered up with a multi-level badge 104 attached to the cavity 103. In addition to the multi-level badge 104, FIG. 1 of the accompanying drawings also shows additional components used to fit inside the overall cavity 103 to complete the golf club head 100. Central cavity badge 106 shown here in FIG. 1 illustrates one of the additional components; wherein the central cavity badge 106 is designed and shaped to fit within an interior opening 105 created in the multi-level badge 104 itself. Finally, the golf club head 100 shown in FIG. 1 shows an exterior badge 108 attached to an external surface of the multi-level badge 104 to complete the golf club head 100. The incorporation of multi-level badge 104 shown in this embodiment of the present invention allows the open cavity 102 to be covered by an aesthetically appealing badge, while at the same time provide a chassis for additional badges to be attached without departing from the scope and content of the present invention.

Figure 2:
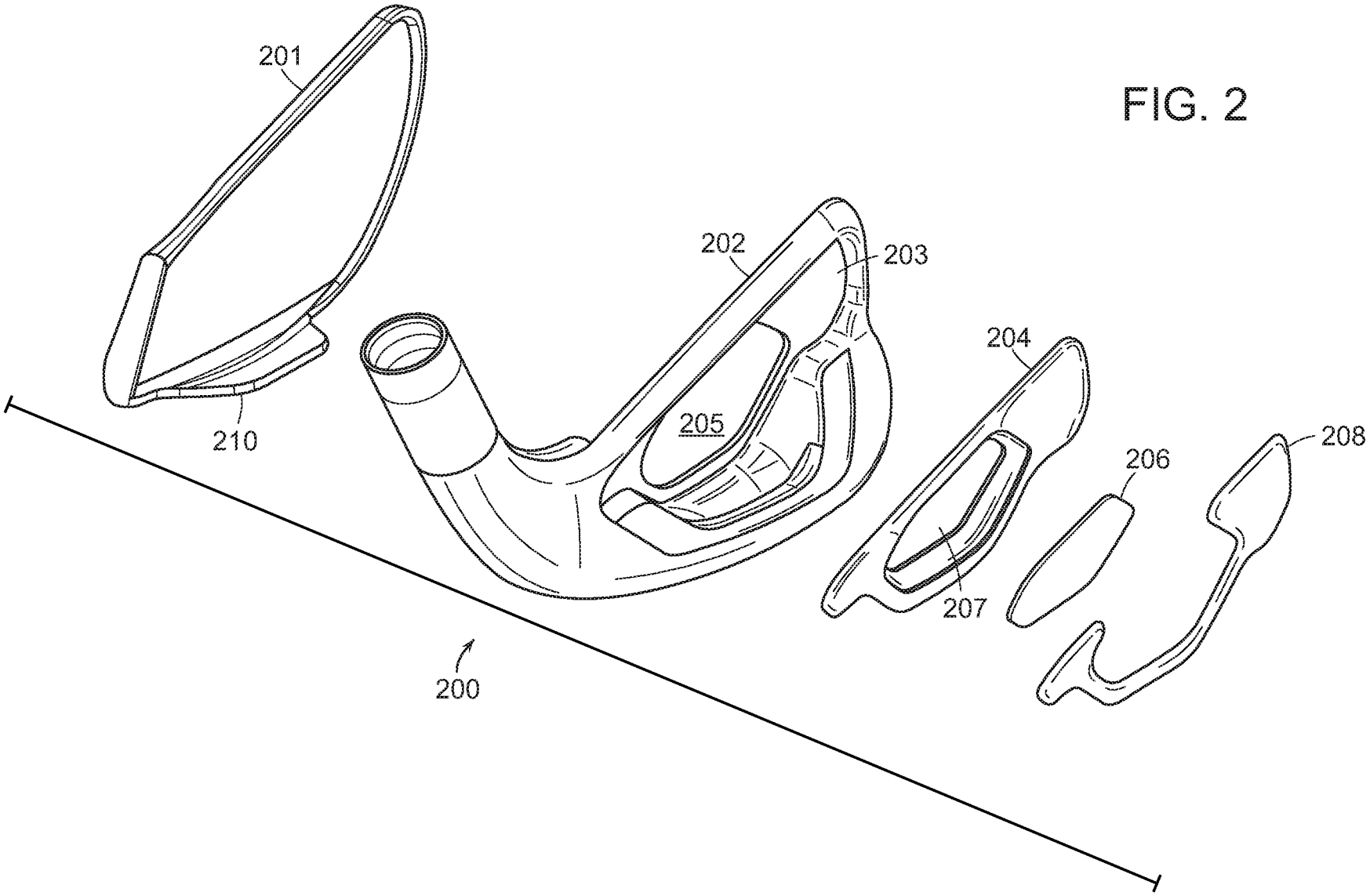
FIG. 2 shows an exploded perspective view of a golf club head in accordance with an exemplary embodiment of the present invention.

FIG. 2 of the accompanying drawings shows an exploded perspective view of a golf club head 200 in accordance with an exemplary embodiment of the present invention allowing the relationship between the various components introduced in FIG. 1 to be shown more clearly. First and foremost, it can be seen here in FIG. 2 that the chassis 202 of the golf club head 200 may be formed separately from the striking face portion 201. The striking face portion 201 shown in this embodiment may generally be formed out of a steel type material to withstand the harsh impact forced with a golf ball; however in alternative embodiments of the present invention the striking face portion 201 may be made out of alternative high strength material such as titanium without departing from the scope and content of the present invention. In addition to the above, it is worth noting here that the striking face 201 may generally contain a sole tab 210 near the bottom of the striking face 201 that corresponds with a sole cutout (not shown) in the chassis 202 of the body of the golf club head 200. The sole tab 210 may generally be beneficial in situations where the striking face 201 is made out of a different material than the chassis 202 of the golf club head 200; as the sole tab 210 allows the weld lines to be removed from an area of high stress that occurs during impact with a golf ball.

FIG. 2 also shows the chassis 202 of the golf club head having a cavity 203 at the rear portion of the chassis 202, creating a cavity type iron. In addition to the cavity 203, the exploded view of the golf club head 200 also shows an interior opening 205 within the cavity 203 with the interior opening 205 interfacing the rear surface of the striking face 201. This opening is critical to the present invention because it allows the multi-level badge 204 to come into contact with the striking face 201 via the interior opening 205, allowing it to provide structural support for the golf club head 200. The multi-level badge 204 shown in FIG. 2 has a secondary cavity 207 corresponding with the size and shape of the interior opening 205 to not only facilitate the engagement one the interior opening 205 and the multi-level badge 204, but also to allow an additional central cavity badge 206 to be added to the rear of the multi-level badge 204. The additions of the central cavity badge 206 shown in FIG. 2 creates an additional badge of aesthetic complexity to the golf club head 200 itself; and at the same time, provide some structural integrity to the secondary cavity 207 of the multi-level badge 204. Finally, the exploded view of the golf club head 200 shows the exterior badge 208 attached to a perimeter of the multi-level badge 204.

Figure 4:
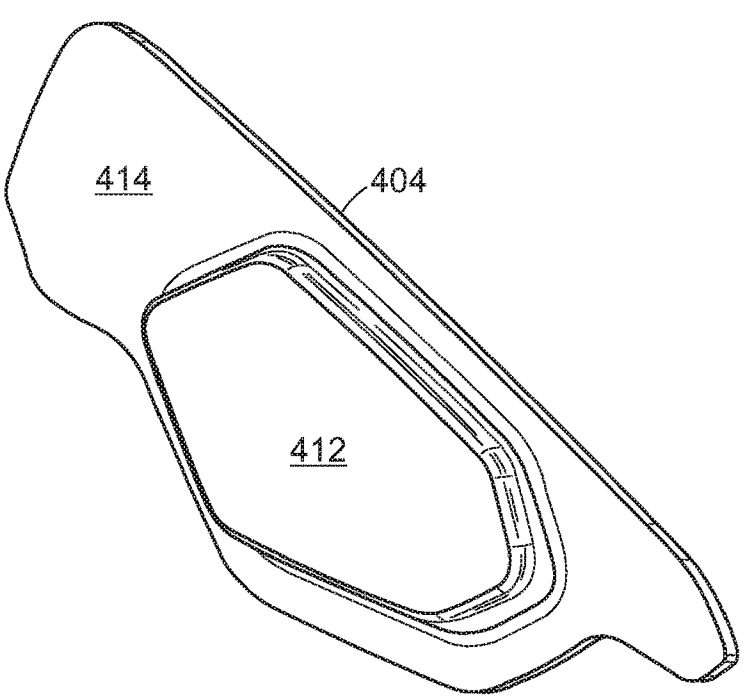
FIG. 4 shows an enlarged frontal view of a multi-level badge in accordance with an exemplary embodiment of the present invention.
Figure 3:
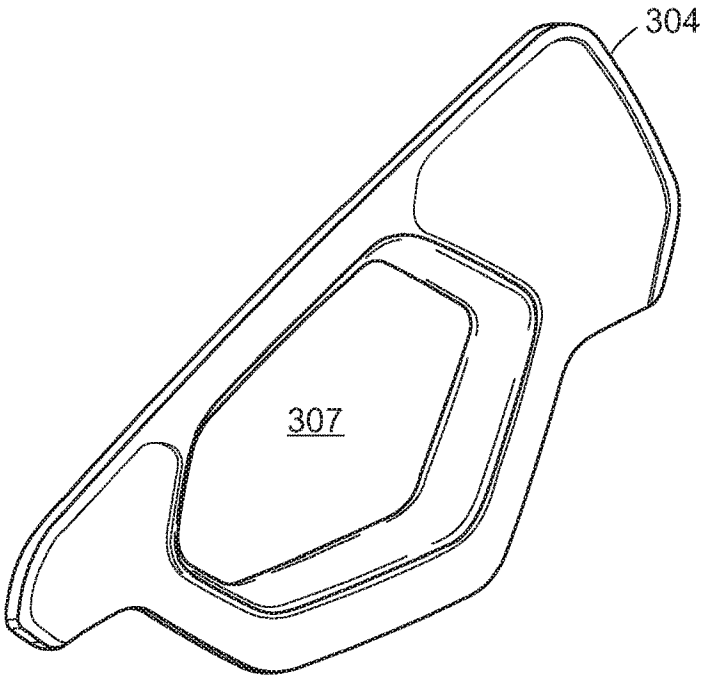
FIG. 3 shows an enlarged rear view of a multi-level badge in accordance with an exemplary embodiment of the present invention.

FIG. 3 of the accompanying drawings shows an enlarged rear perspective view of the multi-level badge 302, allowing this very crucial piece of the golf club head to be shown in more detail. As previously discussed, the rear perspective view of the multi-level badge 302 contains secondary cavity 307, creating the multi-level aspect of the multi-level badge 304. However, in order to truly understand the multi-dimensional and multi-level aspect of the multi-level badge 304, an enlarged frontal perspective view is required. FIG. 4 of the accompanying drawing shows a frontal perspective view of a multi-level badge 404 in accordance with an exemplary embodiment of the present invention. In this frontal perspective view, two different "level" can be identified, which can be important in cross-sectional view of the golf club head to be shown later. First and foremost, it can be seen that the multi-level badge 404 has a first level 412, which in an assembled state, would be the surface that contacts the striking face 201 (shown in FIG. 2). In addition to the first level 412, this frontal perspective view of the multi-level badge 404 also shows the second level 414, which in an assembled state, would contact the a rearward facing surface of the back of the chassis of the golf club head. Alternatively speaking, it can be said that the second level 414 of the multi-level badge 404 circumferentially encompasses the first level 412 of the multi-level badge 404, creating a depression or a secondary cavity 307 (see FIG. 3) near a central portion of the multi-level badge 404.

Figure 5:
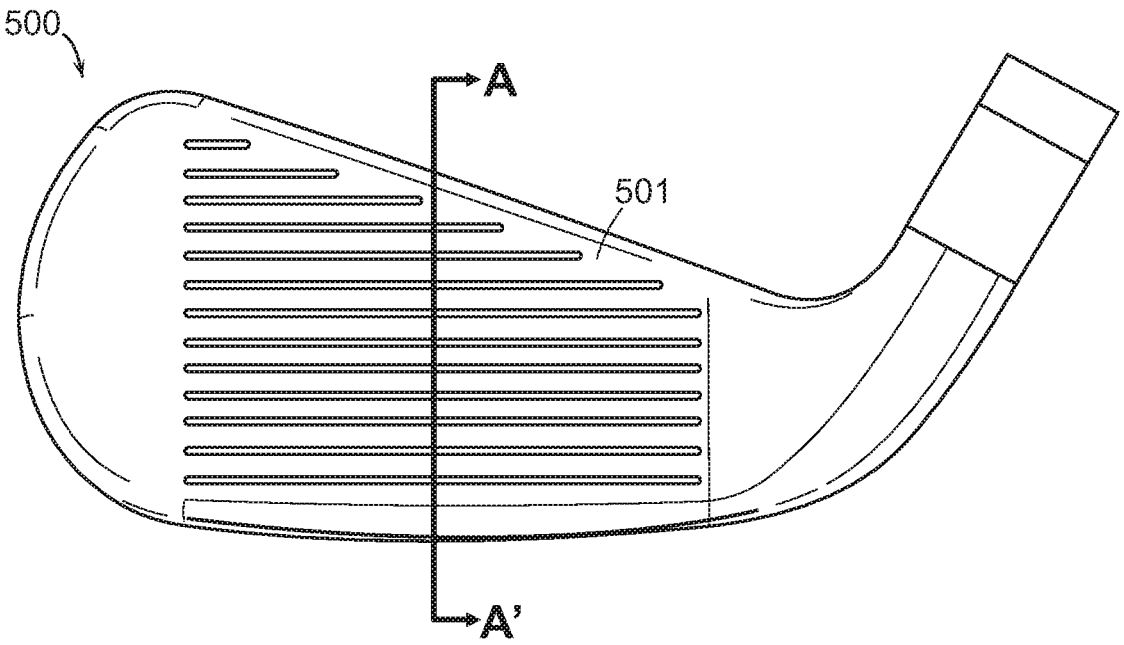
FIG. 5 shows a frontal view of a golf club head in accordance with an exemplary embodiment of the present invention allowing cross-sectional line A-A' to be shown more clearly.

In order to provide an even clearer understanding of the relationship of the various components, a cross-sectional view of the golf club head is extremely beneficial. However, before introducing a cross-sectional view of the golf club head, FIG. 5 is provided illustrating a frontal view of a golf club head 500 so that the cross-sectional line A-A' can be shown. Here in FIG. 5, the cross-sectional line A-A' is shown to bisect the golf club head in a front to back plane, passing through the center of the golf club head that bisects the scorelines.

Figure 6:
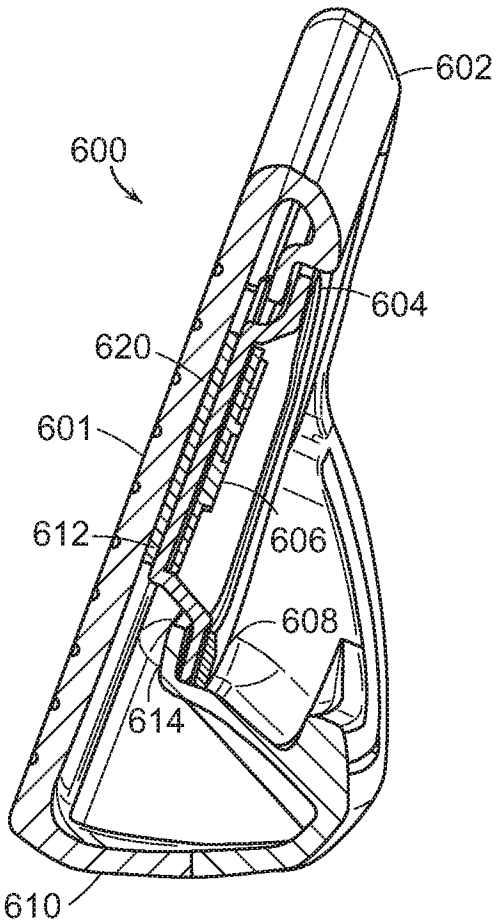
FIG. 6 shows a cross-sectional view of a golf club head in accordance with an exemplary embodiment of the present invention taken along cross-sectional line A-A' shown in FIG. 5.

FIG. 6 of the accompanying drawing shows a cross-sectional view of a golf club head 600 taken along cross-sectional line A-A' shown in FIG. 5. The cross-sectional view of the golf club head 600 allows the various relationships between the components to be shown more clearly. In this cross-sectional view, it can be seen that the striking face 601 is located at a frontal portion of the golf club head 600, wherein the striking face 601 has sole tab 610 extending rearward from the sole portion of the striking face 601. Rearward of the perimeter striking face 601 is the chassis 602 of the golf club head 600, wherein it provides a portion of the topline and a portion of the sole. The chassis 602, in addition to creating additional exterior components of the golf club head 600, also creates a cavity 203 having an opening 205 (see FIG. 2) to allow the multi-level badge 604 to engage multiple surfaces of the golf club head 600.

In this embodiment of the present invention, the first level 612 of the multi-level badge 604 is located at the frontal portion of the golf club head 600, and engages the rear surface of the striking face 601 to help absorb and dampen the harsh effects of the impact with a golf ball. It should be noted here that the first level 612 of the multi-level badge 604 and the rear surface of the striking face 601 may further include a thin badge of polymeric material 620 having a thickness of less than about 1.5 mm, more preferably less than about 1.25 mm, and most preferably less than about 1.0 mm. The polymeric material 620 in this embodiment of the present invention may generally have an adhesive property, creating a bond between the rear surface of the striking face 601 and the first level 612 of the multi-level badge 604. In addition to providing the adhesive properties mentioned above, the polymeric material 620 may generally provide some vibration dampening and structural integrity to the entire golf club head 600. Finally, in an alternative embodiment of the present invention, the polymeric material 620 could be a grommet type attachment mechanism that utilizes the opening 205 to help attach the multi-level badge 604 to the striking face 601. The second level 614 of the multi-level badge 604 in this embodiment here is shown as the forward facing level of the multi-level badge 604 placed at the more rearward position. The second level 614 in this embodiment may generally engage the rearward facing surface of the cavity 203 (see FIG. 2) on the chassis 602 to help distribute and dissipate the impact forces experienced by the first level 612 of the multi-level badge 604.

The different levels of the multi-level badge 604 are so critical to the present invention it is worthwhile here to examine it in more detail here. First and foremost, it is important to recognize that the relationship created by the first level 612 and the second level 614 allows the stress of the impact forces to be dissipated in a completely unique way. More specifically, the present invention, by contacting the multi-level badge 604 at the frontal surface on both the first level 612 and the second level 614, eliminates compressive forces on the multi-level badge 604 and utilizes tension forces on the multi-level badge 604. Tension forces on the multi-level badge 604 is preferred over compressive forces in this embodiment because it distributes the impact forces without adding additional pressure to the rear of the chassis 602 of the golf club head 600.

As a corollary to the unique force distribution achieved by the multi-level badge 604, FIG. 6 of the accompanying drawing also shows another unique feature of the multi-level badge 604. More specifically, the multi-level badge 604 in accordance with the present invention may generally have the first level 612 and the second level 614 touching two different surfaces at two or more different depths within the cavity 203 (see FIG. 2) of the golf club head 600. In this embodiment, the depth of the first level 612 is completely depressed and surrounded by the depth of the second level 614, creating a very unique multi-level badge 604 that allows the multi-level badge 604 to contact the golf club head 600 at different depths.

Figure 7:
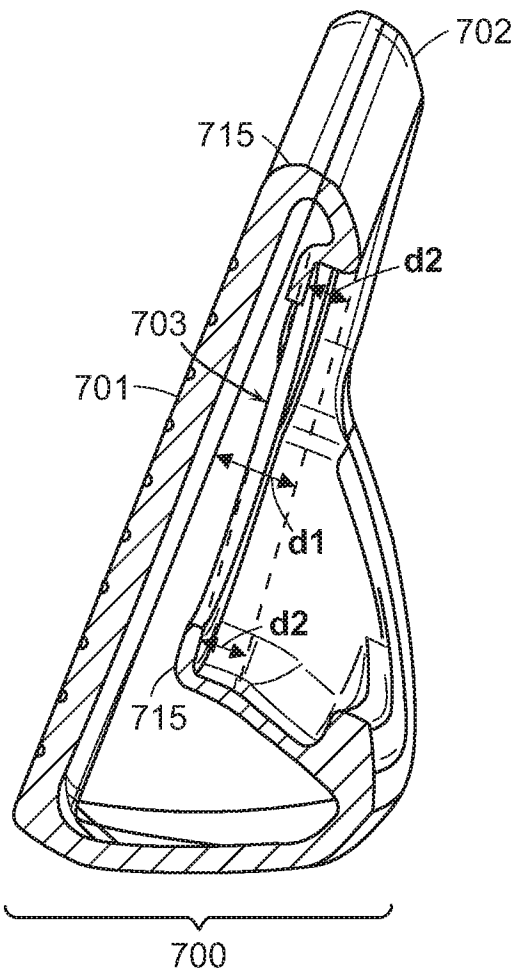
FIG. 7 shows a cross-sectional view of a chassis of a golf club head in accordance with an exemplary embodiment of the present invention taken along cross-sectional line A-A' shown in FIG. 5.
Figure 8:
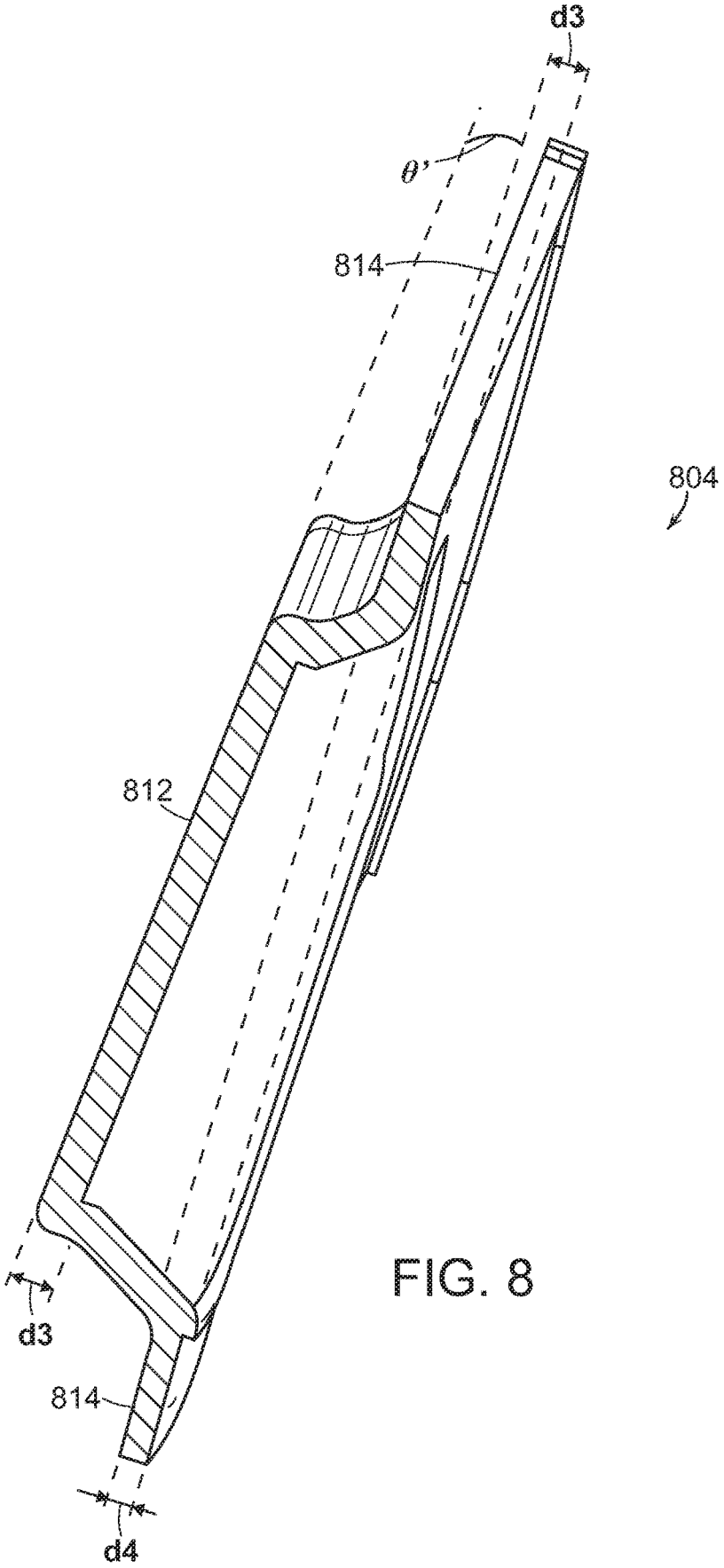
FIG. 8 shows a cross-sectional view of a multi-level badge in accordance with an exemplary embodiment of the present invention taken along cross-sectional line A-A' shown in FIG. 5.

In order to help illustrate the various dimensions discussed above, the chassis 702 and the multi-level badge 804 have been isolated their cross-sectional views shown in FIGS. 7 and 8 respectively. First off, FIG. 7 of the accompanying drawings shows a cross-sectional view of the chassis 702 of the golf club head 700 together with the striking face 701. The striking face, which is placed furthest away from the cavity 703 created by the chassis 702 of the golf club head 700, forms a first cavity depth having a first depth d1. The support tab 715 of the rear of the chassis 702 forms a second cavity depth d2. The one or more support tabs 715 provides a surface for said second level of said multi-level badge to contact said chassis. In this current embodiment of the present invention, the multi-level badge 704 contacts the golf club head 700 at a second cavity depth d2 near a top portion of the golf club head 700 but also contacts the golf club head 700 at a first cavity depth d1 near a central portion of the golf club head 700 before returning to contacting the golf club head 700 at the originally stated second cavity depth d2 near the bottom sole portion of the golf club head 700. In this embodiment of the present invention, d1 is always greater than d2, and d1 may generally be greater than about 3.0 mm, more preferably greater than about 3.25 mm, and most preferably greater than about 3.5 mm. D2, on the other hand, may generally be less than about 2.5 mm, more preferably less than about 2.25 mm, and most preferably less than about 2.0 mm all without departing from the scope and content of the present invention.

FIG. 8 of the accompanying drawing shows a cross-sectional view of the multi-level badge 804 in accordance with an exemplary embodiment of the present invention. This enlarged cross-sectional view of the multi-level badge 804 may show the thickness of the multi-material badge 804 being at a thickness of d3 for a majority of the multi-material badge 804, with specific portions of the multi-material badge 804 at a decreased material thickness of d4 to accommodate the exterior badge. Thickness d3 shown in this current exemplary embodiment may generally be between about 0.8 mm to about 1.2 mm, more preferably between about 0.9 mm to about 1.1 mm, and most preferably about 1.0 mm. Decreased material thickness d4 of the multi-material badge 804 in this current exemplary embodiment may generally be less than about 0.9 mm, more preferably less than about 0.8 mm, and most preferably less than about 0.75 mm all without departing from the scope and content of the present invention.

In addition to illustrating the material thickness, FIG. 8 of the accompanying drawings also shows the first level 812 and the second level 814 being at two different levels of the multi-level badge 804. In addition to the two badges being at different levels, FIG. 8 of the accompanying can be used to help identify the relative angle of the first level 812 and the second level 814 being at an angle θ1. θ1 in the current exemplary embodiment of the present invention may generally be between about 0 and about 20 degrees, more preferably between about 0 and about 10 degree, and most preferably between about 0 and about 5 degrees.

Figure 9:
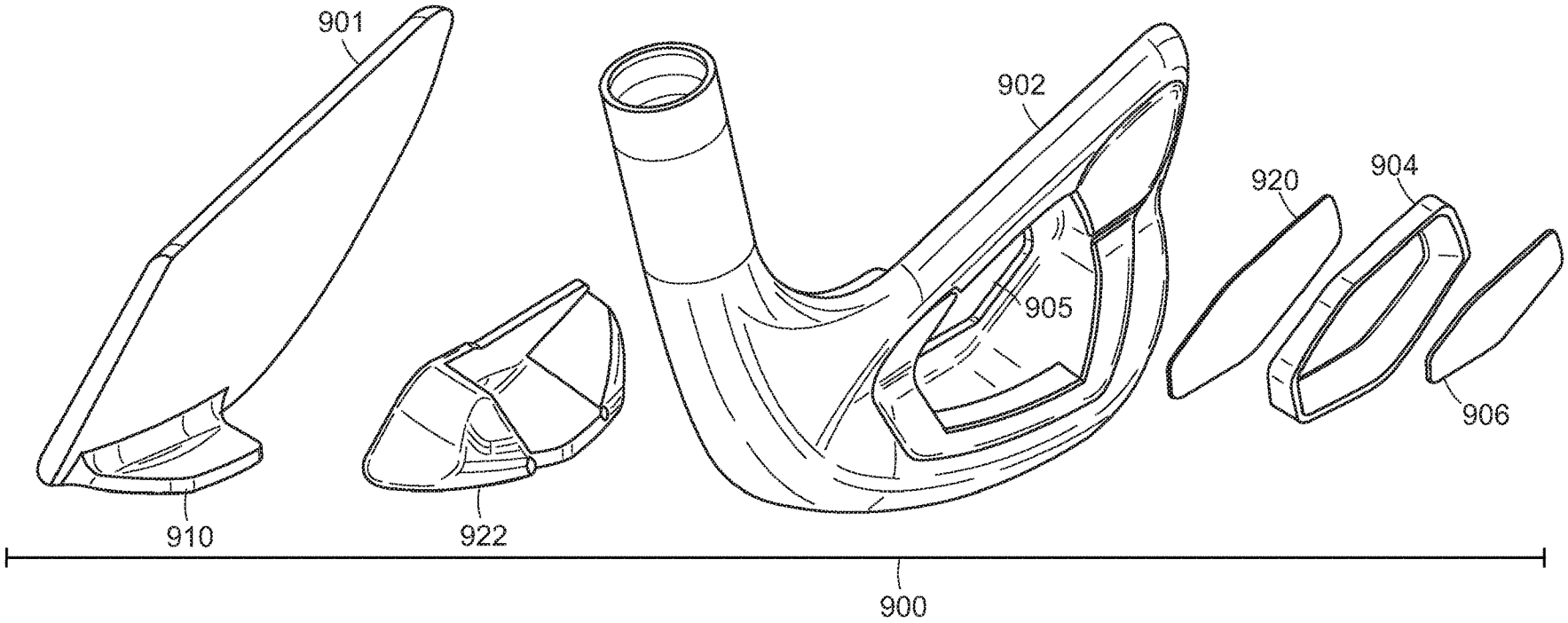
FIG. 9 shows an exploded perspective view of a golf club head in accordance with an alternative embodiment of the present invention.

FIG. 9 of the accompanying drawings shows an exploded perspective view of a golf club head 900 in accordance with an alternative embodiment of the present invention. In this exploded perspective view, the golf club head 900's individual components can be shown more clearly, illustrating the relationship between each of the components. Similar to previous discussions, golf club head 900 may comprise of basis components such as the striking face portion 901 having a sole tab 910 attached to a frontal portion of a chassis 202. The chassis 902 may have an interior opening 905 that allows the rear surface of the striking face portion 901 to be exposed to components at the rear of the golf club head 900 such as the first badge 904 as well as a second interior badge 906. Generally speaking, a polymeric material 920 may be attached to the frontal surface of the first badge 904, with the polymeric material 920 having adhesive properties to allow the badge 904 to be attached with ease.

In addition to the above components, the exploded perspective view of the golf club head 900 shown in FIG. 9 also allows the fluid 922 with a temperature variable viscosity to be shown as it fills the void (shown later in FIG. 10 as 1022) at the bottom of the chassis 902. Placing fluid 922 with temperature variable viscosity 922 at this location allows the fluid 922 with a temperature variable viscosity to contact the rear surface of the striking face portion 901, providing vibration dampening as well as improving the sound of the golf club head 900. The fluid 922 with a temperature variable viscosity, in addition to filling the void 1022 (shown in FIG. 10), also fills the gap between the striking face portion 901 and the frontal surface of the chassis 902. In order to illustrate the void 1024 (shown in FIG. 10) created by the chassis 902, FIG. 10 is provided with an exploded perspective view from a frontal view.

Figure 10:
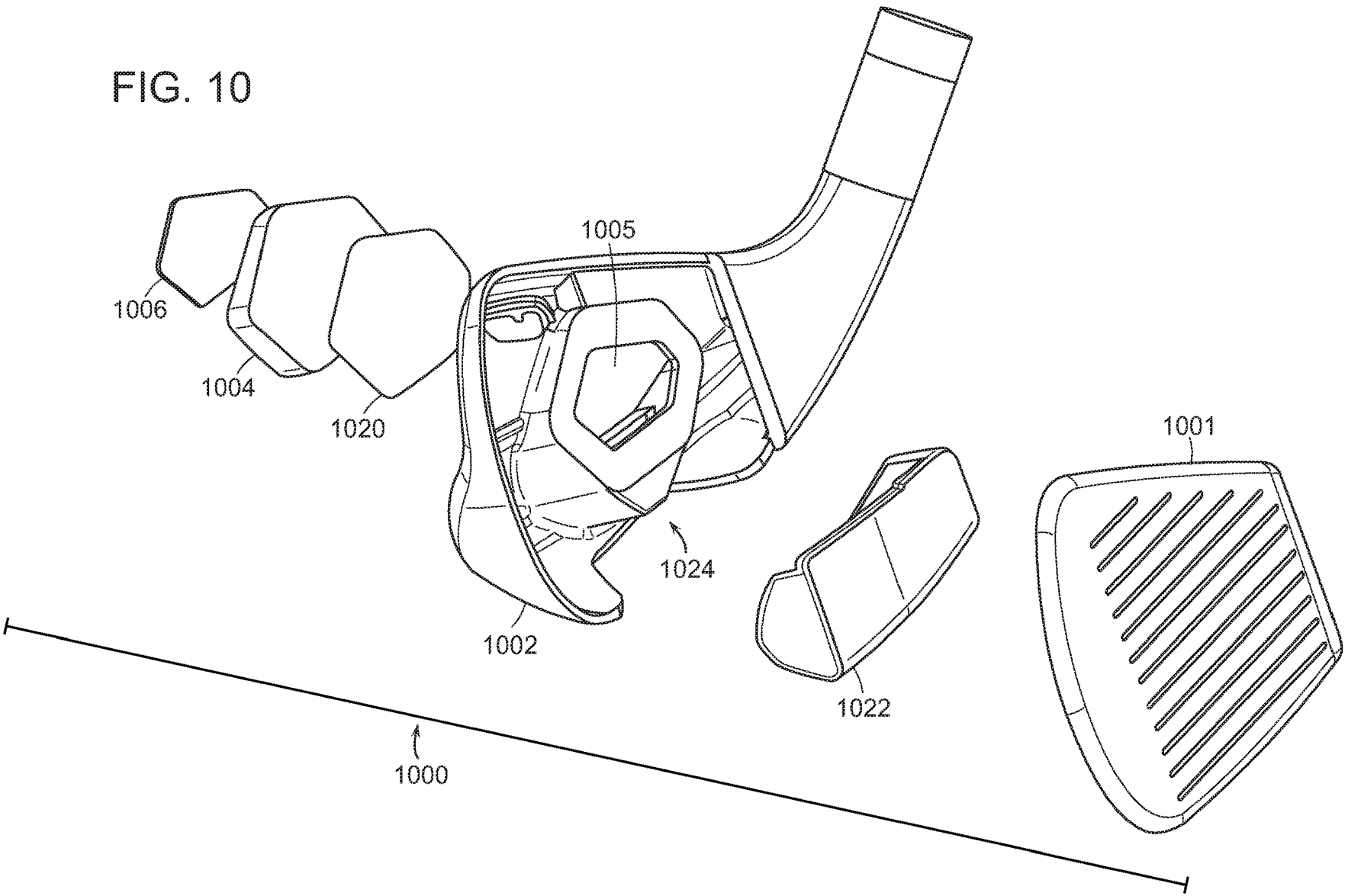
FIG. 10 shows another exploded perspective view of a golf club head in accordance with an alternative embodiment of the present invention.

FIG. 10 of the accompanying drawings shows a frontal exploded view of a golf club head 1000 in accordance with an alternative embodiment of the present invention. More specifically, the exploded view of golf club head 1000 shown in FIG. 10 allows the void 1024 within the chassis 1002 to be shown more clearly. Showing the interior of the chassis 1002 allows the physical boundaries of the fluid 1022 with a temperature variable viscosity to be shown more clearly. Hence it can be seen that as fluid 1022 with a temperature variable viscosity is introduced to the rear of the striking face portion 1001 via the interior opening 1005, the viscous nature of the fluid 1022 with a temperature variable viscosity will cause it to substantially conform to the shape of the interior of the chassis 1002. In one exemplary embodiment of the present invention shown here, the fluid 1022 will weigh between about 2.0 grams to about 8.0 grams, more preferably between about 2.5 grams to about 7.5 grams, and most preferably between about 3.0 grams to about 7.0 grams all without departing from the scope and content of the present invention.

Although FIGS. 9 and 10 show the fluid 922 and 1022 with a temperature variable viscosity taking on a shape that is identical to the void 1024 created by the chassis 1002, the actual shape of the fluid 1022 with the temperature variable viscosity may differ slightly depending on the actual flow characteristic of the fluid 1022 with. In one embodiment of the present invention, the temperature and viscosity may cause the location of the fluid 1022 to be more toe biased, while in another embodiment, the temperature and viscosity may cause the location of the fluid 1022 to be more heel biased, all without departing from the scope and content of the present invention. It should be noted here that irrespective of the actual shape that fluid 1022 takes on, it is important that a portion of the fluid 1022 remains near the gap created by the striking face portion 1001 and the frontal portion of the chassis 1002. This gap allow the fluid 1022 to provide vibration dampening effect, thus minimizing unpleasant sound and feel of the golf club head 1000 when it impacts a golf ball.

The fluid 1022 with a temperature variable viscosity used in this preferred embodiment of the present invention may generally be a pressure sensitive adhesive designed to perform differently at different temperatures. More specifically, the fluid 1022 in this embodiment may be a hot melt type material from H.B. Fuller having a part number HL-2814. The fluid's 1022 temperature variable viscosity may be more specifically defined as having a viscosity of 4,125 cP (mPa·s) at 300° F. and a viscosity of 2,010 cP (mPa·s) at 350° F. Having the variable viscosity at different temperatures allows the fluid 1022 to take on different properties that could allow the fluid to reach locations in the golf club head 1000 that experience significant vibration, and could help address the issue of sound and feel. In addition to the viscosity numbers, it is also worthwhile to recognize that the preferred fluid 1022 may have a loop tack of 45 ounces and a 180 degree peel (60 sec/75 F, 1 Mil) is 2.2 lbs/inch. These properties help identify the stickiness of the fluid 1022 and how it will be attached to the rear surface of the striking face portion 1001.

Figure 11:
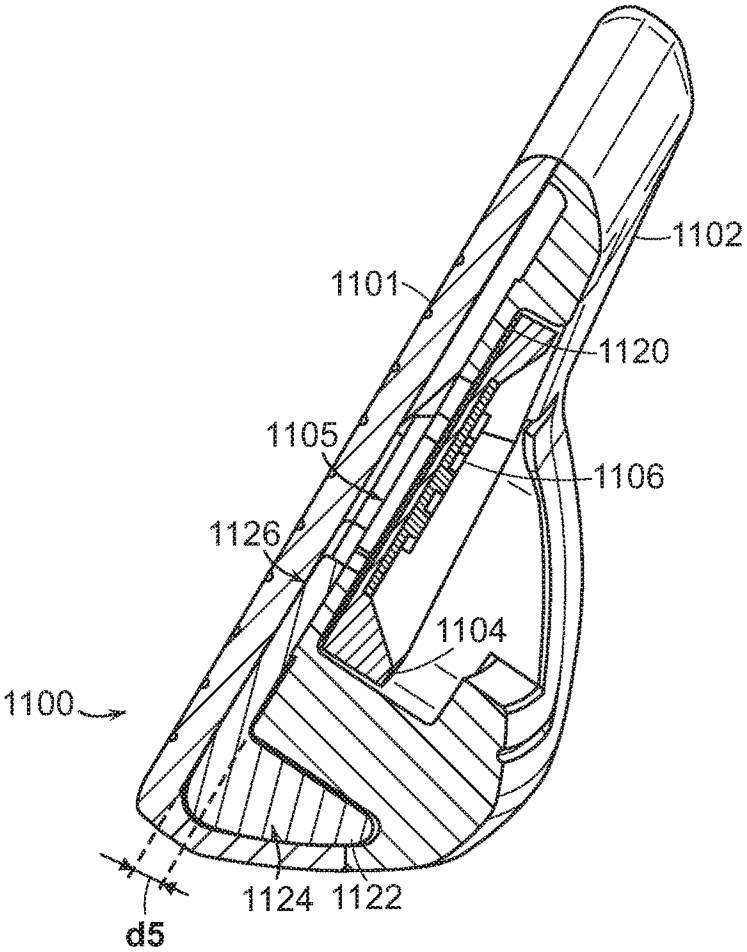
FIG. 11 shows a cross-sectional view of a golf club head in accordance with an alternative embodiment of the present invention taken along cross-sectional line A-A' shown in FIG. 5.

In order to illustrate the specific relationships between the various components shown in this alternative embodiment of the present invention, a cross-sectional view of a golf club head 1100 is provided in FIG. 11. FIG. 11 of the accompanying drawings is cross-sectional view of an alternative embodiment of the present invention taken along cross-sectional line A-A' shown in FIG. 5. The cross-sectional view of the golf club head 1100 shows the fluid 1122 being filled through the interior opening 1105 from the back side of the chassis 1102. The fluid 1122 may flow down via gravity and fill the void 1024 at the lower portion of the chassis 1102 via a gap 1026 created between the rear surface of the striking face 1101 and the frontal lower portion of the chassis 1102. This gap 1026 may generally have a small distance d5 that is between about 1.0 mm to about 3.0 m, more preferably between about 1.5 mm to about 2.5 mm, and most preferably about 1.5 mm.

Having the gap 1026 distance d5 at the small distance identified above is critical to the proper functioning of the present invention as it provides a small enough gap 1026 for which the fluid with temperature variable viscosity 1122 can provide support to the striking face portion 1101 while also contacting the frontal surface of the sole muscle portion of the chassis 1102. In addition to that, the gap 1026 also needs to be large enough to allow the fluid 1022 to flow through the gap 1026 and reach the void 1022 at the bottom of the golf club head 1100. This gap 1026 distance d5 not only allows the fluid 1122 to stay sandwiched between the striking face portion 1101 and the chassis 1102, but also allows the fluid with temperature variable viscosity 1122 to flow towards the lower void 1124 portion of the chassis 1102 without departing from the scope and content of the present invention.

Figure 12:
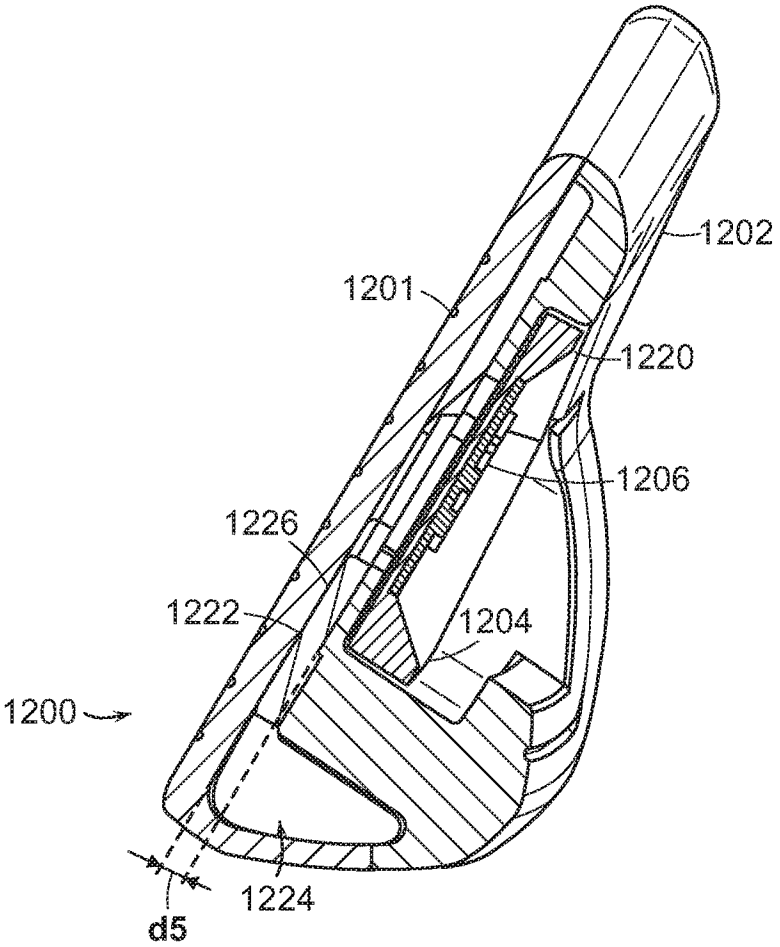
FIG. 12 shows a cross-sectional view of a golf club head in accordance with an alternative embodiment of the present invention taken along cross-sectional line A-A' shown in FIG. 5.

FIG. 12 of the accompanying drawings shows a cross-sectional view of a golf club head 1200 in accordance with an alternative embodiment of the present invention. In this embodiment, it can be seen that the fluid 1222 only fills the gap 1126 portion of the golf club head 1200, and does not fill the void 1224 portion. This embodiment of the present invention may be preferred in situations wherein less fluid 1222 is needed, and concentration of the fluid 1222 at the gap 1226 creates the vibration dampening desired without adding additional fluid 1222.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head;

a chassis, connected to an aft portion of said striking face portion, creating a rear cavity having an opening, wherein said opening provides access to a rear surface of said striking face portion, wherein said rear surface of said striking face portion and a lower frontal portion of said chassis creates a gap and a void;

wherein said gap is placed above and connected to said void, and a fluid, with temperature variable viscosity, at least partially filling said gap;

wherein said fluid does not fill said void, and wherein said fluid has a viscosity of about 4,125 cP (mPa·s) at 300° F., and a viscosity of about 2010 cP (MPa·s) at 350° F.

2. The golf club head of claim 1, wherein said fluid at least partially contacts said rear surface of said striking face portion at only a lower portion of said striking face portion.

3. The golf club head of claim 1, wherein said fluid at least partially contacts an internal frontal surface of said chassis at only a lower frontal portion of an internal surface of said chassis.

4. The golf club head of claim 1, wherein said gap has a distance of between about 1.0 mm to about 3.0 mm.

5. The golf club head of claim 4, wherein said gap has a distance of between about 1.5 mm to about 2.5 mm.

6. The golf club head of claim 5, wherein said gap has a distance of about 1.5 mm.

7. The golf club head of claim 1, wherein said fluid has a mass of between about 2.0 grams to about 8.0 grains.

8. The golf club head of claim 7, wherein said fluid has a mass of between about 2.5 grams to about 7.5 grains.

9. The golf club head of claim 8, wherein said fluid has a mass of between about 3.0 grams to about 7.0 grains.

10. The golf club head of claim 1, wherein said fluid has a loop tack of 45 ounces.

11. The golf club head of claim 1, wherein said fluid has a 180 degree peel (60 sec/75F, 1 Mil) of about 2.2 lbs/inch.

* * * * *